United States Patent [19]

Narui et al.

[11] Patent Number: 4,687,680

[45] Date of Patent: Aug. 18, 1987

[54] STAMPING FOIL

[75] Inventors: Hiroshi Narui, Uji; Terumi Shinohara, Joyo, both of Japan

[73] Assignee: Oike Industrial Co., Ltd., Kyoto, Japan

[21] Appl. No.: 805,257

[22] Filed: Dec. 5, 1985

Related U.S. Application Data

[62] Division of Ser. No. 566,252, Dec. 28, 1983, abandoned.

[51] Int. Cl.[4] ..... B05D 3/06

[52] U.S. Cl. ..... 427/38; 427/147; 427/148; 427/208.2; 427/208.8; 427/250; 427/264; 427/265; 427/294; 427/341; 204/192.15; 204/192.31

[58] Field of Search ..... 428/202, 209, 201; 427/148, 147, 294, 250, 38, 264, 208.2, 208.8, 265, 341; 204/192

[56] References Cited

U.S. PATENT DOCUMENTS

| | | | |
|---|---|---|---|
| 4,012,552 | 3/1977 | Watts | 427/147 |
| 4,242,378 | 12/1980 | Arai | 427/264 |
| 4,421,816 | 12/1983 | Arnold | 428/202 |
| 4,477,312 | 10/1984 | Czichy | 428/209 |
| 4,495,232 | 1/1985 | Bauser et al. | 427/96 |

FOREIGN PATENT DOCUMENTS

| | | | |
|---|---|---|---|
| 0146792 | 11/1981 | Japan | 427/147 |
| 0146793 | 11/1981 | Japan | 427/147 |
| WO79/00103 | 3/1979 | PCT Int'l Appl | 427/147 |

*Primary Examiner*—Norman Morgenstern
*Assistant Examiner*—Janyce A. Bell
*Attorney, Agent, or Firm*—Armstrong, Nikaido, Marmelstein & Kubovcik

[57] ABSTRACT

A stamping foil which comprises a flexible supporting web, a lubricating layer provided on substantially whole one surface of the supporting web, a colored water-resistant resinous layer having a desired pattern and a metal deposition layer having a desired pattern provided on the lubricating layer, and an adhesive layer provided in a manner that all of the exposed surfaces of the lubricating layer, of the colored water-resistant resinous layer and/or of the metal deposition layer are covered by the adhesive layer. The stamping foil has an advantage that even a complicated combined pattern of the colored layer and the metal deposition layer can be obtained by a single operation with ease and low cost.

8 Claims, 5 Drawing Figures

STAMPING FOIL

This application is a division of application Ser. No. 566,252 filed 12/28/83 now abandoned.

BACKGROUND OF THE INVENTION

The present invention relates to a stamping foil containing a colored resinous layer and a metal deposition layer, both of which having a desired pattern respectively.

There has been known a method of forming a variety of desired patterns (including letters, figures, designs, and the like) on a surface of paper, leather, plastic sheet, molding, wood, fabric and the like, employing a technique using stamping foil.

According to the method, a pattern on a transferable layer of a stamping foil is transferred to the surface of the substrate by setting the foil on the surface of the substrate and pressing the foil against the substrate with an embossing press or roller, usually a press or roller which is heated.

There is a demand that a combined pattern of a colored resinous layer having a desired pattern and a metallic lustrous layer having a desired pattern is required to form on a surface of a transparent substrate such as a plastic molding product or film, leaving transparent portions of the original substrate as occasion demands.

According to the above-mentioned transferring techinque, such a combined pattern is formed on the surface of the substrate as follows: First, a stamping foil having a colored resinous layer all over the one side surface thereof as a transferrable layer is pressed by means of an embossing press or roll, thereby a pattern of the colored resinous layer is transferred onto the substrate. When a multi-colored pattern is required, such a pressing operation should be repeated with changing the stamping foil having a different colored resinous layer. Then a stamping foil having a metal deposition layer all over the one side surface thereof as a transferable layer is pressed on the pattern of the colored layer by means of an embossing press or roll, thereby a pattern of the metal deposition layer is transferred onto the substrate. It will be clearly understood from the above description that two or more transferring operations are required for the formation of the combined pattern in the above-mentioned technique.

Consequently, in case that a complicated pattern having a plurality of colors and a metallic luster is formed by the conventional technique, many transferring operations are needed so that the transferring method becomes expensive by itself. Also, when to the substrate on which the first colored pattern has been formed the second colored pattern is transferred, it is essentially required that the second colored pattern is formed in a desired position on a surface of the substrate with respect to the first one. However, the operation for such a precise positioning is troublesome and technically difficult.

The object of the present invention is to provide a stamping foil which can be employed to give a combined pattern of a desired pattern of a colored resinous layer and a desired pattern of a metallic lustrous layer onto a substrate surface by a single transferring operation.

SUMMARY OF THE INVENTION

According to the present invention, there is provided a stamping foil which includes a flexible supporting web, a lubricating layer provided on substantially the whole of one surface of the supporting web, a colored water-resistant resinous layer having a desired pattern and a metal deposition layer having a desired pattern provided on the lubricating layer, and an adhesive layer provided in a manner that all of the exposed surfaces of the lubricating layer, of the colored water-resistant resinous layer and/or of the metal deposition layer are covered by the adhesive layer, the metal deposition layer being formed by providing a water-soluble coating layer in a desired pattern on the lubricating layer and/or on the colored resinous layer, providing a metal deposition layer to cover all the exposed surfaces, and removing the water-soluble coating layer and the metal deposition layer thereon by water-washing.

The invention will be understood from the following description in reference to the accompanying drawings.

DETAILED DESCRIPTION

Figure 1:
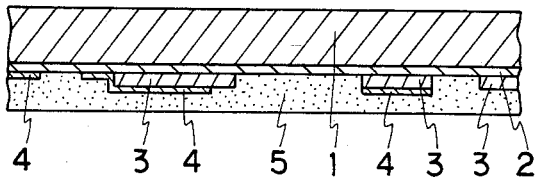
FIG. 1 is a fragmentary vertical section illustrating one embodiment of the stamping foil according to the present invention.

Referring first to FIG. 1, there is illustrated the stamping foil of the present invention which contains a flexible supporting web 1, a lubricating layer 2 provided on substantially the whole of one surface of the supporting web 1, a colored resinous layer 3 having a desired pattern and a metal deposition layer 4 having a desired pattern provided on the lubricating layer 2, and a heat sensitive or pressure sensitive adhesive layer 5 provided to cover all the exposed surfaces.

The stamping foil of the present invention is prepared in a series of the process described hereinafter in conjunction with FIGS. 2 to 4.

Figure 2:
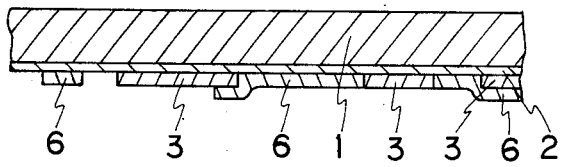
FIGS. 2 to 4 are, respectively, fragmentary vertical sections illustrating various steps of a preparation of the stamping foil of FIG. 1.

As in FIG. 2, first, onto the substantially the whole of one surface of the flexible supporting web 1 is applied the lubricating layer 2, the colored water-resistant resinous layer 3 having a desired pattern is formed on the latter by using printing ink, and then the water-soluble coating layer 6 is formed by using water-soluble paint on the lubricating layer 2 and/or the colored resinous layer 3 to have a pattern which lies in the areas corresponding to the portions to be removed of a metal deposition layer which is to be formed later so as to cover all the exposed surfaces.

Figure 3:
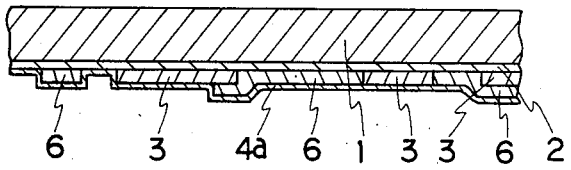

Referring to FIG. 3, the metal deposition layer **4*a* is formed to cover all the surfaces including the surfaces of the colored water-resistant resinous layer 3, the water-soluble coating layer 6 and, if any, the lubricating layer 2** which still remains exposed.

Figure 4:
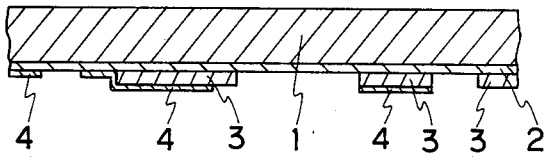

By washing the thus obtained laminate shown in FIG. 3 including the above-mentioned layers with water, the water-soluble coating layer 6, and thus, the metal deposition layer **4*a* deposited thereon are removed from the laminate to leave a metal deposition layer 4 having a desired pattern as shown in FIG. 4. Consequently, the areas from which the metal deposition layer 4a** was removed provide the see-through portions when transferred. Water-washing can be completed, for example, by immersion or shower, etc.

Finally the adhesive layer 5 is formed by applying an adhesive to cover all the exposed surfaces including the surfaces of the lubricating layer 2, the colored resinous layer 3 and the metal deposition layer 4, and thereby there is prepared the stamping foil of the present invention which contains a combined pattern of the colored resinous layer 3 and the metal deposition layer 4 as shown in FIG. 1.

The flexible supporting web 1 which can be used in the invention is a water-resistant web, and preferably a heat-resistant web when employed for a heat-transfer stamping foil. Examples of such a water-resistant and/or heat-resistant web include polymer films such as polyester film, polyamide film and polypropyrene film. Thickness of the web 1 is in the range of about 10 to about 25 μm.

In the present invention the lubricating layer 2 allows the pattern to be removed more easily from the support web and provides superior in durability because it serves as a protecting layer for the transferable layer 7 after transferred. Also, because the method of preparation of the stamping foil of the present invention includes a water-washing step, the lubricating layer 2 is required to be superior in water-resistance. The lubricating layer 2 is formed by applying and drying a paint which mainly contains resins, such as acrylic resin, cellulose acetate, chlorinated polyolefine resin; or rubbers, such as chlorinated rubber, cyclized rubber. The lubricating layer 2 is transparent and uncolored.

The colored resinous layer 3 is formed with water-resistant printing ink. When using ordinary printing ink, it is preferable to make a protecting layer over the colored resinous layer 3 thereof for the purpose of preventing the tendency for the ordinary printing ink to discolor when heated during the vacuum deposition. The colored resinous layer 3 may be formed either as a one-colored resinous layer by using one printing ink or as a multi-colored resinous layer by using several printing ink. The printing inks usable in the present invention has preferably an excellent transparency.

The formation of the water-soluble coating layer 6 is achieved by applying and drying water-soluble paint which contains as a main component casein, glue, gelatin, polyvinylalcohol, methylcellulose, hydroxyethylcellulose, polyvinylpyrrolidone or vinyl methyl ether-maleic anhydride copolymer, etc. The thickness of the water-soluble coating layer 6 is preferably in the range from about 0.5 to about 3 μm. When the thickness is over 3 μm, it takes a long time to dissolve and to remove the coating layer 6 completely and it is difficult to perform a deposition of metal because a large amount of gas is generated during the deposition. On the other hand, when the thickness is below 0.5 μm, it becomes difficult to remove the metal deposition layer 4a sufficiently clear during water-washing which is on the water-soluble coating layer 6.

The colored resinous layer 3 and the water-soluble coating layer 6 may be formed either independently or simultaneously by using multi-color printing machine.

The above-mentioned lubricating layer 2, colored resinous layer 3 and water-soluble coating layer 6 are formed ,for example, by means of a gravure roll coater.

According to the present invention, metal employable in the metal deposition layer 4a is a simple metal of aluminium, tin, silver, gold, copper, nickel, chromium, zinc or the alloy thereof. The thickness of the metal deposition layer 4a is generally in the range from about 30 to about 100 mμ. The formation of the metal deposition layer 4a is achieved by a usual method, such as vacuum deposition method, sputtering method or ion-plating method. It is preferable to proceed into the next water-washing step after aging for a few days at normal temperature after the metal deposition layer 4a is formed.

In the water-washing process, the laminate which comprises each layer described hereinbefore is, for example, immersed into water having a temperature from about 40° to about 60° C. for 5 to 20 sec, thereby the water penetrates in the metal deposition layer 4a and reaches the water-soluble coating layer 6. The water dissolves the coating layer 6 so as to remove the layer 6 and the metal deposition layer 4a which covers the layer 6 together with. Consequently, the metal deposition layer 4 in a desired pattern is left on the laminate.

For the formation of the adhesive layer 5, usual pressure sensitive adhesive and/or heat sensitive adhesive can be selectively employed depending on a kind of the material of the substrate. For example, the heat-sensitive adhesives include one that contains mainly the cyclized rubber (for moldings of polyethylene), one that contains mainly the acrylic resins (for moldings of acrylic resins) and one that contains mainly the polyvinylacetate resins or the vinylchloride-vinylacetate copolymer resins (for paper). The product names shown in the parentheses hereinbefore are suitable substrates respectively. Also, the pressure-sensitive adhesives include one that contains mainly the carboxyl containing-polyacrylates, such as the copolymer of the alkylacrylates and acrylic acid or methacrylic acid. Non-exclusive examples of the alkylacrylates are 2-ethylhexylacrylate, butylacrylate, and the like.

Figure 5:
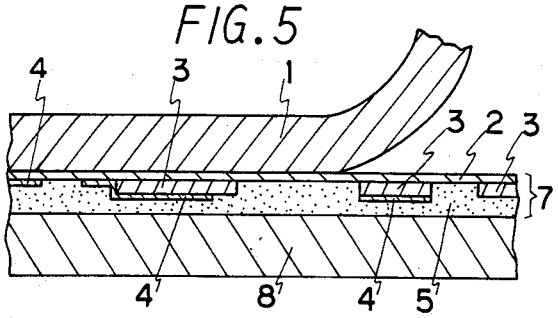
FIG. 5 is a fragmentary vertical section illustrating the method of transferring the transferable layer of the stamping foil of FIG. 1.

FIG. 5 shows one scheme in the transferring process using the stamping foil of the present invention. In case that the adhesive layer 5 is a heat-sensitive adhesive layer, the transferring operation proceeds as follows: First, the stamping foil is set down on the substrate 8 in a manner that the adhesive layer 5 is connected to the substrate surface. The stamping foil is then heated and pressed wholly with a heat roll from the upper side. After cooling, the supporting web 1 is peeled off to apart from the transferable layer 7 at a boundary to the lubricating layer 2 as shown in FIG. 5. Consequently, the transferable layer 7 is transferred to the substrate 8. In case that the adhesive layer 5 is formed with a pressure-sensitive adhesive, the transferable layer can be transferred only by pressing the stamping foil with a roll.

In contrast with a conventional multi-stage transferring process employing an embossing press or roll, necessitating troublesome operation which leads to high cost and takes a long time to complete, the method to transfer the transferable layer of the stamping foil of the present invention includes pressing above the whole surface of the stamping foil with or without heating to obtain a pattern onto the substrate.

As explained hereinbefore, the stamping foil according to the present invention provides the easy and simple transferring process that a colored pattern and a metal luster pattern can be formed simultaneously on the substrate in a single operation, and therefore has an advantage that a complicated pattern is obtained with ease and low cost which cannot be formed by means of a conventional stamping foil.

The stamping foil according to the present invention can be preferably used to form a variety of patterns consisting of a colored pattern and a metal luster pattern on the various kinds of paper, book wrapper, natural or artificial leather, plastic moldings, toy, artificial flower, or the like.

It is further understood by those skilled in the art that the foregoing description is a preferred embodiment of the disclosed stamping foil and that various changes and modifications may be made in the invention without departing from the spirit and scope thereof.

What is claimed is:

1. a method for making a stamping foil comprising:

(a) spreading a flexible supporting web;

(b) applying a transparent and colorless lubricant layer over said flexible supporting web;

(c) applying a colored resinous layer over portions of said lubricant layer;

(d) applying a water-soluble coating layer over at least a part of one or both of said lubricant layer and said resinous layer so that the water-soluble coating layer is formed on ares corresponding to subsequent portions to be removed;

(e) depositing a layer of metal over essentially all of the exposed sufaces;

(f) washing the surface with an aqueous solution or water to remove metal coated upon the water-soluble coating layer; and (g) applying a layer of adhesive over substantially the whole surface.

2. The method for making a stamping foil according to claim 1 wherein the flexible supporting web is a water-resistant polymeric film.

3. The method for making a stamping foil according to claim 1 wherein the lubricant layer is a paint which contains resins selected from the group consisting of acrylic resin, cellulose acetate resin, and chlorinated polyolefin resin.

4. The method for making a stamping foil according to claim 1 wherein the lubricant layer is a paint containing a rubber selected from the group consisting of chlorinated rubber and cyclized rubber.

5. The method for making a stamping foil according to claim 1 wherein the water-soluble coating layer is a paint containing a water-soluble film-forming compound selected from the group consisting of casein, glue gelatin, polyvinyl alcohol, methyl cellulose, hydroxyethyl cellulose, polyvinylpyrrolidone and vinyl methyl ether-maleic anhydride copolymer.

6. The method for making a stamping foil according to claim 1 wherein the metal layer is deposited by vacuum deposition.

7. The method for making a stamping foil according to claim 1 wherein the metal layer is deposited by sputtering.

8. The method for making a stamping foil according to claim 1 wherein the metal layer is deposited by ion-plating.

* * * * *